US006099932A

United States Patent [19]

Gehring

[11] Patent Number: 6,099,932

[45] Date of Patent: Aug. 8, 2000

[54] LOOP FABRIC FOR HOOK AND-LOOP TYPE FASTENER AND METHOD OF MAKING THE SAME

[75] Inventor: G. Gregory Gehring, Baldwin, N.Y.

[73] Assignee: Gehring Textiles, Inc., New York, N.Y.

[21] Appl. No.: 09/001,783

[22] Filed: Dec. 31, 1997

[51] Int. Cl.[7] ..... B32B 33/00

[52] U.S. Cl. ..... 428/91; 428/99; 442/314

[58] Field of Search ..... 428/91, 99; 442/314

[56] References Cited

U.S. PATENT DOCUMENTS

| | | |
|---|---|---|
| 299,985 | 6/1884 | Jennings . |
| 2,155,385 | 4/1939 | Amic . |
| 2,229,469 | 1/1941 | Newman . |
| 2,435,897 | 2/1948 | Newman . |
| 2,893,226 | 7/1959 | Lombardi . |
| 2,914,836 | 12/1959 | Montgomery . |
| 3,090,097 | 5/1963 | Ruckstuhl . |
| 3,213,646 | 10/1965 | Van Patten . |
| 3,277,673 | 10/1966 | Lesley . |
| 3,475,926 | 11/1969 | Ruckstuhl . |
| 3,710,598 | 1/1973 | Wilkens . |
| 3,837,983 | 9/1974 | Strahl et al. . |
| 3,845,641 | 11/1974 | Waller . |
| 4,467,625 | 8/1984 | Kurz . |
| 4,705,710 | 11/1987 | Matsuda ..... 428/92 |
| 4,894,060 | 1/1990 | Nestegard ..... 604/391 |
| 5,019,073 | 5/1991 | Roessler et al. ..... 604/391 |
| 5,214,942 | 6/1993 | Peake, III et al. . |
| 5,267,453 | 12/1993 | Peake, III et al. . |
| 5,656,351 | 8/1997 | Donaruma ..... 428/97 |

FOREIGN PATENT DOCUMENTS

| | | |
|---|---|---|
| 152517 | of 1920 | United Kingdom . |
| 153037 | of 1920 | United Kingdom . |
| 419281 | of 1934 | United Kingdom . |
| 883111 | of 1961 | United Kingdom . |
| 1204384 | of 1967 | United Kingdom . |

*Primary Examiner*—Terrel Morris
*Assistant Examiner*—Ula C. Ruddock
*Attorney, Agent, or Firm*—Gottlieb, Rackman & Reisman, P.C.

[57] ABSTRACT

A loop component for a hook-and-loop fastener includes a knit fabric and a plurality of loops extending along one surface of the fabric and made of a monofilament pile yarn such as nylon. The component is knit on a three or more bar machine with one bar forming the base and two or more additional bars forming floats which are then pulled out of the knit fabric by napping to obtain a fabric having a predetermined thickness. The fabric is then heat sense to stabilize is dimensions, stiffness and other physical properties.

7 Claims, 3 Drawing Sheets

LOOP FABRIC FOR HOOK AND-LOOP TYPE FASTENER AND METHOD OF MAKING THE SAME

BACKGROUND OF THE INVENTION

A. Field of Invention

This invention pertains to a novel knit material constructed and designed for a hook-and-loop type fastener, said material being stronger and longer lasting then previous such materials. The invention further pertains to a method of making said material.

B. Description of the Prior Art

Hook-and-loop fasteners are very popular for a large variety of applications because they have many properties which make them inherently more desirable then other types of fasteners. For instance, because these types of fasteners are made of woven or knit fabrics, they can be made of any color, are more decorative and they can blend easily with the base layers supporting the same. The fasteners are especially preferable for both infants and old people because they require much less physical dexterity then other types of fasteners (such as for example, buttons).

Typically, hook-and-loop fasteners consist of two facing flat components, each component being formed of a flat, usually ribbon-type base fabric which can be cut to any desired size. One of the components, the hook or male component includes a plurality of relatively stiff curved, open elements made of a monofilament yarn and extending away from the base fabric. The loop or female component consists of a plurality of pile type closed loops extending away from the base fabric so that when the two components are mated with each other, some of the hooks engage or pass through many of the loops thereby providing a coupling between the two components. When a normal force is applied between the two components, for example by pulling one of the components away from the other, the hooks separate from the loops.

Typically, the hooks were made in the prior art from a monofilament while the loops were made from a multifilament yarn (as described for instance in U.S. Pat. No. 5,267,453, incorporated herein by reference). The loop component was typically made using a two bar knitting machine and conventional napping and related processes.

A problem with existing hook-and-loop fasteners is that the loops wear off and/or are matted down easily and hence very soon there is insufficient 'adherence' between the two components. Therefore the fastener becomes ineffective because it is easy to peel and has low shear strength. A further disadvantage is that the existing fastener has a high proportion of yarn in the base of the fabric, rather than the pile. However since the primary function of the fabric is to provide the pile loops, this structure results in a fabric which is cost ineffective and has a weight which is not optimal for the physical performance.

One reason why the existing fasteners have poor cycle life is that the multifilament construction allows the loops to mat because of the fine denier of the loops which makes them easy to deform from the optimal erect position. Moreover, because standard loop components are made using a two bar knitting process, the resulting fabric has only a limited stability. However in some applications the component must be stable and rigid. Stability in these applications is achieved by applying additional bonding materials or foam. This step renders the loop component more expensive and adds the complication that it may delaminate.

Attempts to resolve this problem has included increasing the density and/or the weight of the yarns making up the loops however, this solution makes the fasteners more expensive. As discussed in more detail below, part of the problem with the existing fasteners is that the hooks engage only some of the filaments making up the loops. As a result, when the components are separated, the filaments are relatively weak and break. Therefore, after several uses, many of the loops become open and the whole fastener becomes useless.

OBJECTIVES AND SUMMARY OF THE INVENTION

It is an objective of the present invention to provide a hook-and-loop fastener with an improved loop component which has a long useful life when compared to other, existing loop components.

A further objective is to provide a loop component which can be used with a variety of different hook components.

Yet another objective is to provide a loop structure which is inexpensive to manufacture yet it is strong and resilient to wear and tear when compared to existing loop structures.

A further objective is to provide an efficient method of making the improved loop component.

These objectives are achieved in the present invention by providing a hook-and-loop fastener wherein the loop component is a knit fabric with said loops being formed by a monofilament yarn. Importantly the loop component is made using a special knitting technique and unconventional napping and processing steps. More specifically, a loop component constructed in accordance with this invention includes a knit base fabric and a pile of a plurality of loops extending erect away from one surface thereof, said loops being made of monofilament pile yarn. Preferably, the fabric is made on a three-or-four-bar knitting machine. One bar is used to knit the base structure while the other two bars are used to generate floats. A very aggressive napping process is then applied to force the floats to form the erect pile loops. A backing may be applied to the side opposite the loop. The fabric is then heat set to stabilize the loops as well as the dimensions of the fabric. Preferably the loops are formed from nylon or other synthetic material.

DETAILED DESCRIPTION OF THE INVENTION

The present invention presents a hook-and-loop fastener with the loop component having a new and improved loop structure with a superior performance and outstanding stability through its useful life. The fastener incorporating the improved loop structure is preferably designed for specific industrial applications such as footwear, upholstery, safety devices, health care equipment, sports equipment, geriatric apparatus, hospital and other medical devices, automotive devices and so on. The fastener is made of light yarns and provides excellent performance based on its specific weight.

Figure 1:
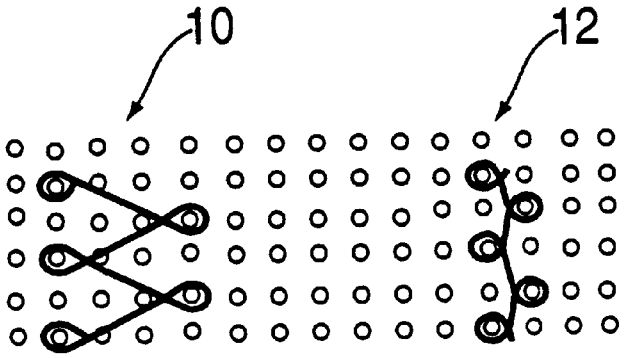
FIG. 1 PRIOR ART
FIG. 1 shows a prior art arrangement point diagram for knitting a loop component.

More specifically, a hook-and-loop fastener constructed in accordance with this invention includes an improved loop component comprising a base fabric formed of a warp knit from nylon or similar threads and having a raised pile made of a monofilament yarn, said pile defining the loops for the fastener. First referring to FIG. 1, prior art loop components for hook-and-loop fasteners were knitted using only two bars 10, 12. Moreover, in the prior art, the front or pile bar 10 was moved over only four needle spaces as indicated.

In the present invention a three bar knitting process is used (see FIG. 2), i.e., a loop component is constructed using a back bar 14, a middle bar 16 and a front bar 18. The two bars 16, 18 cooperate to jointly form the loop pile whereby a much higher density of surface loops is obtained per unit area because the number of threads in the pile has been doubled as compared to the prior art. Preferably the pile yarn is not a multifilament yarn but instead it is a monofilament yarn made of nylon or other similar synthetic fabric and having a denier in the range of 10–150, depending on the particular end use of the fastener for many applications. For example, a loop pile of denier monofilament yarn is particularly suited for many applications.

Figure 2:
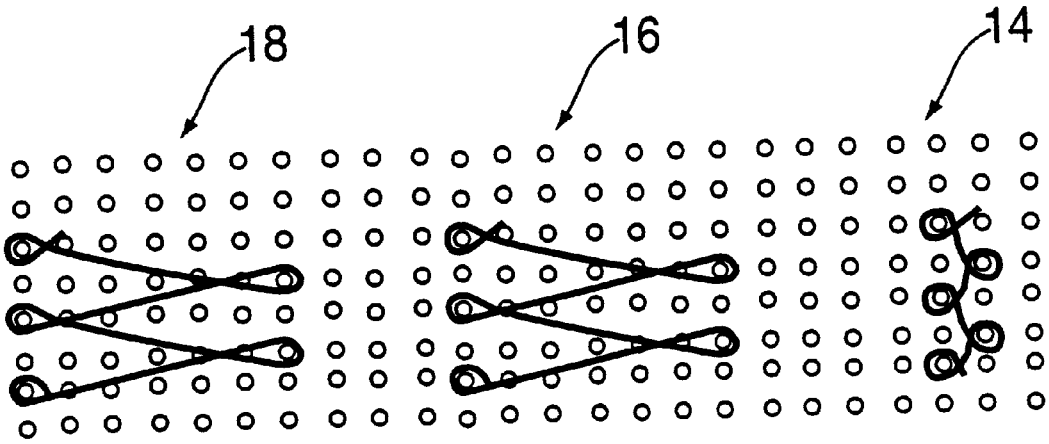
FIG. 2 shows a point diagram for knitting a loop component of a hook-and-loop fastener in accordance with the present invention.
Figure 3:
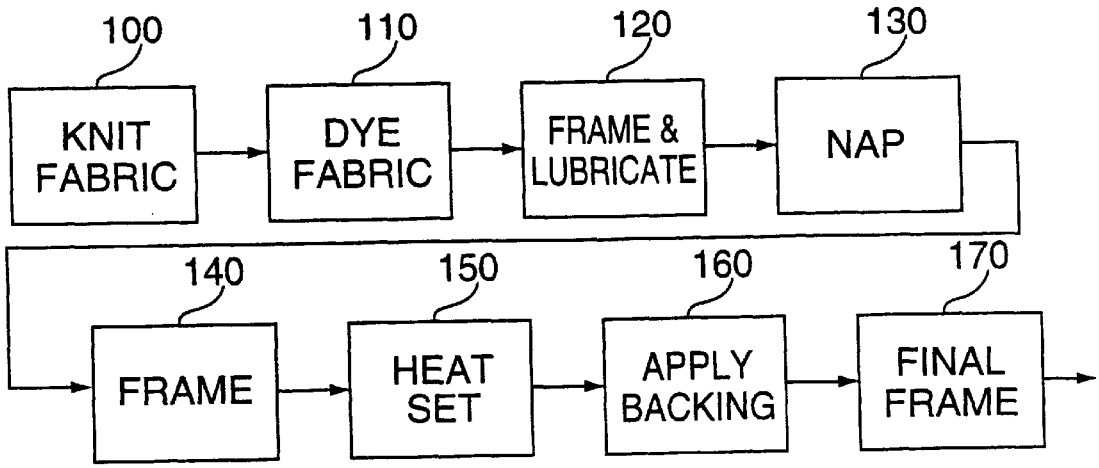
FIG. 3 shows a block diagram of the process used to generate the subject loop component.

The fabric shown in FIG. 2 may be produced on a 3-bar or 4-bar tricot machine. The fabric is knit preferably on a 24, 28 or 32 gauge machine. The base structure or warp knit base is knit using the back guide bar 14 executing a movement of 1-0/1-2//. The two front guide bars are used to produce the floats arranged into two respective coextensive float systems over 6 needles executing a movement of 1-0/6-7// using the above-mentioned monofilament. The floats are then pulled out to produce the superior loops as described in more detail below. The six needle jump shown is necessary for the napping process to be successful in raising the loops of the monofilament yarns. Of course, longer jumps in the range of suitable for napping may also be used. Referring now to FIG. 3, the loop component is generated using the following steps. First in step 100, the basic loop component is knit using the three bar technique described above, The result is a basic fabric which may be for example about 168" wide. If desired, the basic fabric may be cleaned and scoured of dirt and stains.

Next, in step 110, the basic fabric is dyed to any desired color using conventional techniques and is allowed to dry. Next, in step 120, the fabric is framed and treated with lubricant to facilitate napping. Preferably during this step, the fabric is pulled down by about 50–60% of its original width, to induce buckling of the yarn floats. Hence, the napping hooks can properly engage and pull out the floats.

Figure 4:
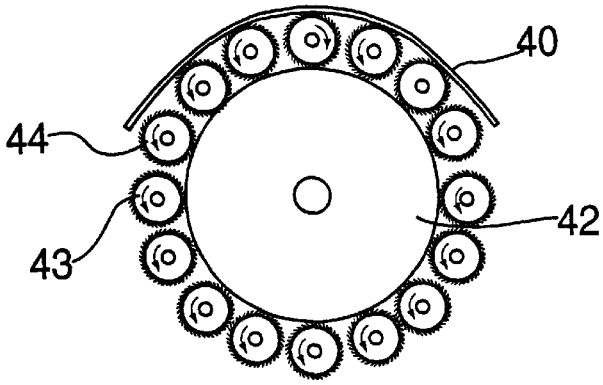
FIG. 4 shows a side view of the napping process.

Next in step 130 the fabric is napped. More specifically, as shown in somewhat diagrammatically in FIG. 4, the fabric 40 from step 120 is moved passed a drum 42 with wheels 43 having a plurality of wire hooks 44. These hooks are flexible enough so that they engage the floats of the material 40. The floats are pulled out of the fabric plane and extend generally perpendicularly thereto to form unbroken loops.

Importantly, step 130 is repeated several times in succession to cause more and more loops 46 to gradually rise and extend above the plane of fabric 40 as far as possible. It has been found that good results are obtained if the napping is repeated at least four more times. The actual details of the napping process depend to a large extent on the construction of fabric, the denier of the monofilament yarn and other desired parameters of the final product.

During napping, the fabric 40 shrinks in width to about 40% of its original width. The thickness of the fabric with the loops at the end of napping may be about 0.097 in., dependant on how many times napping is repeated. In the prior art the thickness of the fabric is about 0.04 inches. While napping is conventional in the art to make other types of fabrics, such as velvets, the present fabric has different surface characteristics. More specifically, the napped surface of the fabric does not have the soft smooth 'velvety' feel and touch or appearance because the napped floats are made of relatively rigid monofilament yarns. The novel process of forming the loops in this manner provide important advantages which are not found in the prior art loop components.

Next, in step 140 the fabric is framed again to stretch it to its nominal width, for instance about 60 inches.

Next, in step 150 the fabric is heat set by passing through an oven and subjecting it to about 320 degrees F. for about 1–2 minutes. This heat setting step causes the size and shape of the raised loops and the thickness of the fabric to be stabilized.

In order to insure that the loop component can withstand numerous opening and closing cycles (in the order of several thousands) and to enhance the fabric's stability, the loops are next locked into place. For this purpose a backing is applied to the fabric in step 160. More specifically the backing process involves running the fabric on a tenter frame over a steel drum and under a reservoir of the backing solution and allowing the solution to impregnate the fabric. A doctor blade (not shown) is used to scrap off excess backing material. Typically the backing solution consists of an acrylic, melamine or other similar resinous material mixed in an aqueous solution. To complete the application of the backing, the fabric, while still on the tenter frame is ran through another heating station where radiant heat is applied to the fabric to dry and set the resin. Once dried, the fabric becomes stiff. The degree of stiffness is determined by the speed of the tenter frame, the viscosity of the resin, the thickness of the backing (set by the position of the doctor blade) and the temperature of the radiant heat.

Finally, in step 170 the fabric is stretched again to its nominal width and heat set at a temperature of 320–325 degrees F. and the backing is stabilized and cured. The backing further increases the dimensional stability and adds rigidity to the fabric. Steps 160 and 170 are preferably performed sequentially on the same tenter frame.

Figure 5:
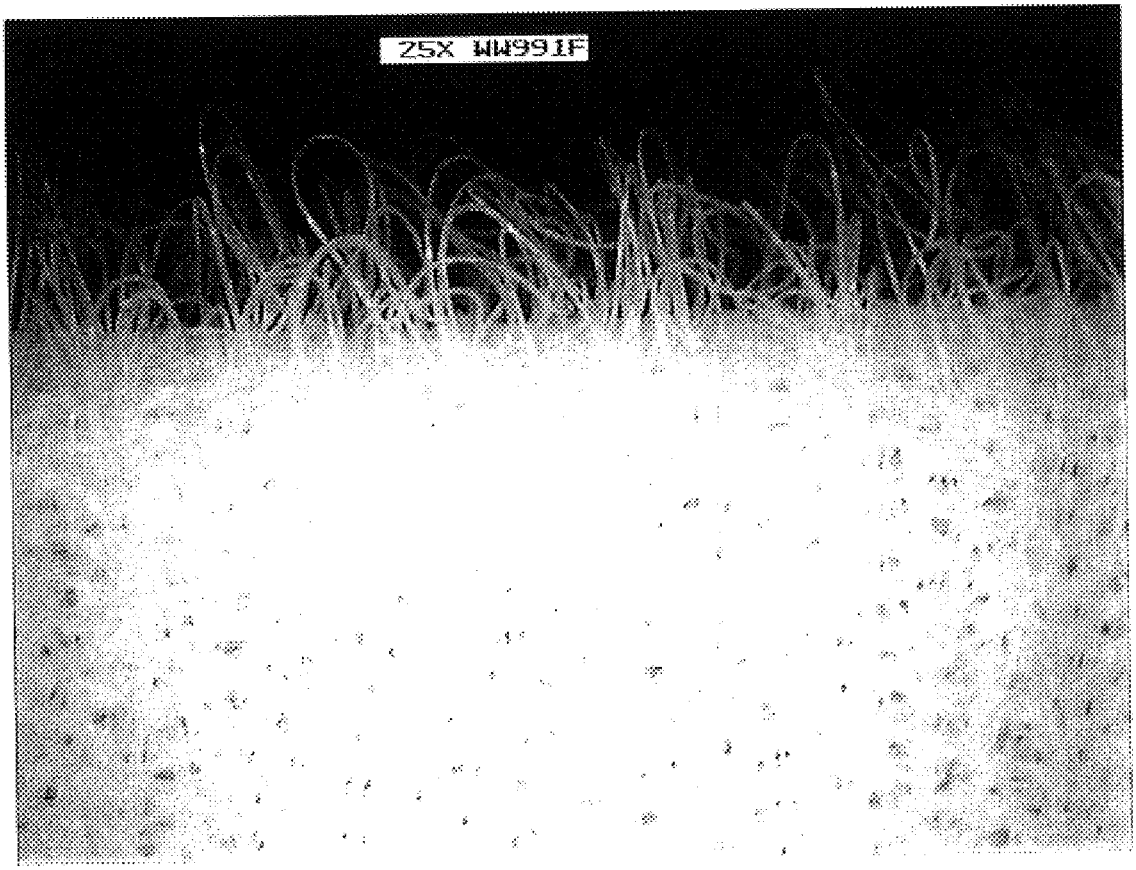
FIG. 5 shows a cross-sectional microscopic view of the loop component constructed in accordance with the present invention.

FIG. 5 shows a microscopic photograph of a cross section of the loop component using the present invention. As can seen in this picture, the component includes a dense population of monofilament loops, the loops being randomly distributed in various directions As previously mentioned the loop component thus generated has a high cycle life. For instance, prior art loop components had a life cycle of 50–5000 operations, In fact some loop components used for certain specific applications such as diapers may have a life time of only 3–4 cycles. Typical prior art loop components have about 2400 loops per sq. in. The present component may have about 2000 loops per sq. in.

Because of the rigidity and strength of the loops of the present loop component, it has been determined that the present loop component has a lifetime of up to over 100,000 cycles. This effect is due in addition to the fact that the loops of the pile are more resistant to matting and remain erect for a much longer time than multifilament loop components.

Another advantage of the invention is that because of the higher density of loops per unit area, more hooks and loops are engaged then in the prior art, and hence the fastener using the subject loop component has a high peel and sheer strength, as well as a high tension and latched strength. It is believed that by using a three bar construction, only 25% of the pile yarns is contained in the base fabric, the rest being disposed in the loops.

Moreover the subject loop component is has a low weight for its closure performance it requires less materials and hence cheaper to make.

Finally, the fabric is more stable then previous loop components.

Obviously numerous modifications may be made to the invention without departing from its scope as defined in the appended claims.

I claim:

1. A loop component for a hook-and-loop fastener, said loop component comprising:

a warp knit base formed by a plurality of interconnected yarns; and a plurality of continuous long floats extending away from the knit base and attached thereto, said long floats being made of a monofilament pile yarn, said floats being formed into loops for the hook-and-loop fastener, wherein said loops are arranged in co-extensive loop systems or extending in the same direction.

2. A loop component for a hook-and-loop fastener comprising:

a warp knit base formed of interlocking yarns, including a pile yarn formed of a monofilament and formed of a plurality of floats disposed on a surface of said warp knit base, wherein said floats have been pulled out of said fabric by napping to form loops along said one surface of said fabric, wherein said loops are arranged in co-extensive loop systems or extending in the same direction.

3. The loop component of said claim 2 wherein said knit fabric is formed on a multiple bar knitting machine including a first bar forming said base and a second and third bars, each forming floats over said base, said floats being pulled during napping to form said loops.

4. The loop component of claim 3 wherein said monofilament is made of nylon.

5. The loop component of claim 3 further comprising a backing applied to one side of said fabric.

6. The loop component of claim 5 wherein said loops and said backing are heat set.

7. The loop component of claim 3 wherein each said second and third bars generate corresponding separate float systems.

* * * * *